US005434476A

United States Patent [19]

Franke

[11] Patent Number: 5,434,476

[45] Date of Patent: Jul. 18, 1995

[54] CIRCUITRY FOR OPERATING FLUORESCENT LAMPS WITH NO STROBOSCOPIC EFFECTS

[76] Inventor: Harald Franke, Hauptstrasse 48, D-44651 Herne, Germany

[21] Appl. No.: 204,322

[22] PCT Filed: Sep. 4, 1992

[86] PCT No.: PCT/EP92/02042

§ 371 Date: Apr. 28, 1994

§ 102(e) Date: Apr. 28, 1994

[87] PCT Pub. No.: WO93/05628

PCT Pub. Date: Mar. 18, 1993

[30] Foreign Application Priority Data

Sep. 6, 1991 [DE] Germany ..... 41 29 682.6

[51] Int. Cl.[6] ..... H05B 37/00

[52] U.S. Cl. ..... 315/184; 315/185 R; 315/209 R; 315/210; 315/228; 315/231; 315/232; 315/DIG. 5

[58] Field of Search ..... 315/184, 312, 185 R, 315/DIG. 5, 209 R, 210, 231, 228, 232

[56] References Cited

U.S. PATENT DOCUMENTS

| | | | |
|---|---|---|---|
| 3,660,716 | 5/1972 | Gorton | 315/228 |
| 3,725,733 | 4/1973 | Mack et al. | 315/228 |
| 4,117,377 | 9/1978 | Jimerson et al. | 315/232 |

*Primary Examiner*—Robert J. Pascal
*Assistant Examiner*—Reginald A. Ratliff
*Attorney, Agent, or Firm*—Collard & Roe

[57] ABSTRACT

Circuitry is disclosed for operating with no stroboscopic effects at least three fluorescent lamps connected to a single source of single phase alternating voltage. In order to suppress the stroboscopic effects, the first lamp circuit (1) is connected in the usual way to both conductors (S;Mp) of the source of single phase alternating voltage; a series oscillating circuit (4) composed of an inductive resistor (L) and a capacitor(C) is arranged in parallel to the first lamp circuit; the second lamp circuit (2) is connected between a conductor (S) of the source of single phase alternating voltage the point of connection (Vp) between the inductive resistor (L) and the capacitor of the series oscillating circuit (4); and the third lamp circuit (3) is connected between said point of connection (Vp) and the other conductor (Mp) of the source of single phase voltage.

3 Claims, 2 Drawing Sheets

CIRCUITRY FOR OPERATING FLUORESCENT LAMPS WITH NO STROBOSCOPIC EFFECTS

Figure 1:
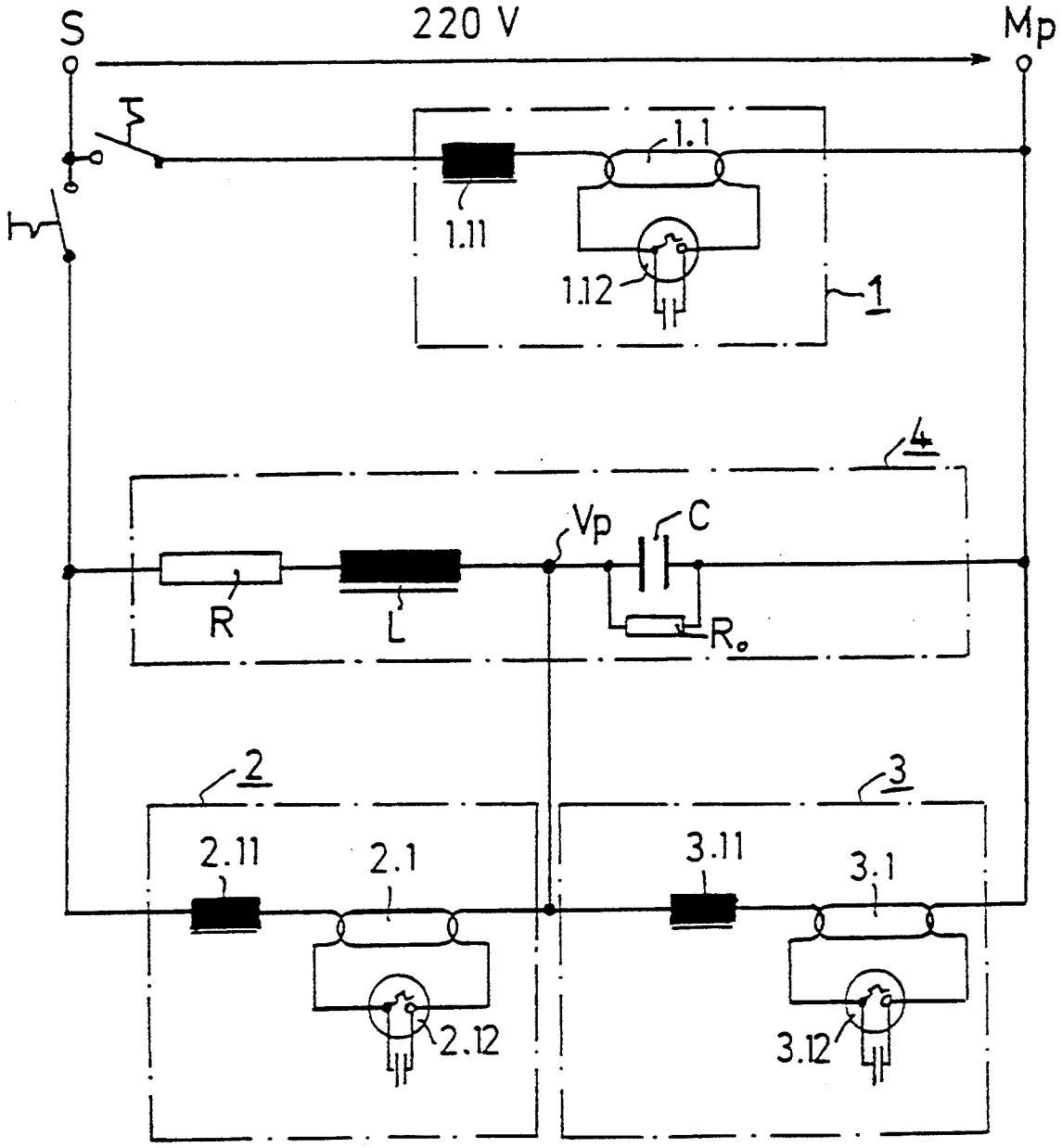

The invention relates to a circuit arrangement for operating fluorescent lamps on a single-phase alternating voltage source without stroboscopic effects, whereby each lamp circuit has at least one inductivity and one starter device.

The fluorescent lamps used for lighting purposes in almost all spheres of technology, business or residential homes have the property that the luminous flux with the double frequency of the electric power feeding the fluorescent lamps oscillates, in a way still visible to the human eye. Such oscillation is perceived as glimmering and, when processes of rapid motion especially of rotating objects are observed, leads to stroboscopic effects, which may considerably interfere with the perception and cause optical illusions. Consequently, such light sources may pose a substantial hazard in the workplace. Furthermore, phenomena of fatigue and headaches often have to be attributed to such glimmering.

For reducing glimmering and the stroboscopic effects, it is known to connect each of the three fluorescent lamps in each case to one phase of the three-phase mains. This causes the luminous fluxes coming from said three fluorescent lamps to heterodyne in a way such that overall, a largely uniform luminous flux is obtained with a degree of uniformity $\Phi$ of about 0.95. However, three-phase current connections are not always available.

For avoiding glimmering and the stroboscopic effects, use is made in connection with single-phase alternating voltage sources of so-called duo-circuits, with which a degree of uniformity $\Phi$ of about 0.7 can be achieved, as compared to a single circuit (degree of uniformity $\Phi$ about 0.5 to 0.6).

The invention is based on the problem of further developing the circuit arrangement of the type specified above in a way such that the glimmering and the stroboscopic effects are avoided to the highest possible degree.

Said problem is solved on the basis of a circuit arrangement of the type specified above in that

- a first lamp circuit is connected in the conventional way to the two conductors of the single-phase alternating voltage source;
- a series oscillating circuit consisting of an inductive resistor and a capacitor is arranged in parallel with the first lamp circuit; and
- a second lamp circuit is connected between the one conductor of the single-phase alternating voltage source and the point of connection of the inductive resistor and the capacitor of the series oscillating circuit, and a third lamp circuit is connected between said point of connection and the other conductor of the single-phase alternating voltage source.

Through the circuitry proposed in accordance with the invention it is possible to achieve in a single-phase alternating voltage network a light that is free of glimmering and stroboscopic effects to the highest possible degree due to overlapping of the light fluxes, as it can be obtained comparatively only in three-phase current installations. With the circuit arrangement according to the invention it is readily possible to obtain a degree of uniformity $\Phi$ of the luminous flux of 0.95.

Usefully, the phase displacement between the three lamp circuits amounts to 60°. Owing to such phase displacement between the three lamp circuits, a particularly uniform luminous flux is obtained, whose oscillations are practically no longer perceivable to the human eye.

According to a particularly preferred embodiment, each lamp circuit has at least two fluorescent lamps connected by a duo-circuit. In this way, an even further increase in uniformity is achieved. The light coming from the six fluorescent lamps of such a circuit arrangement has an overall degree of uniformity of almost 1.

Figure 2:
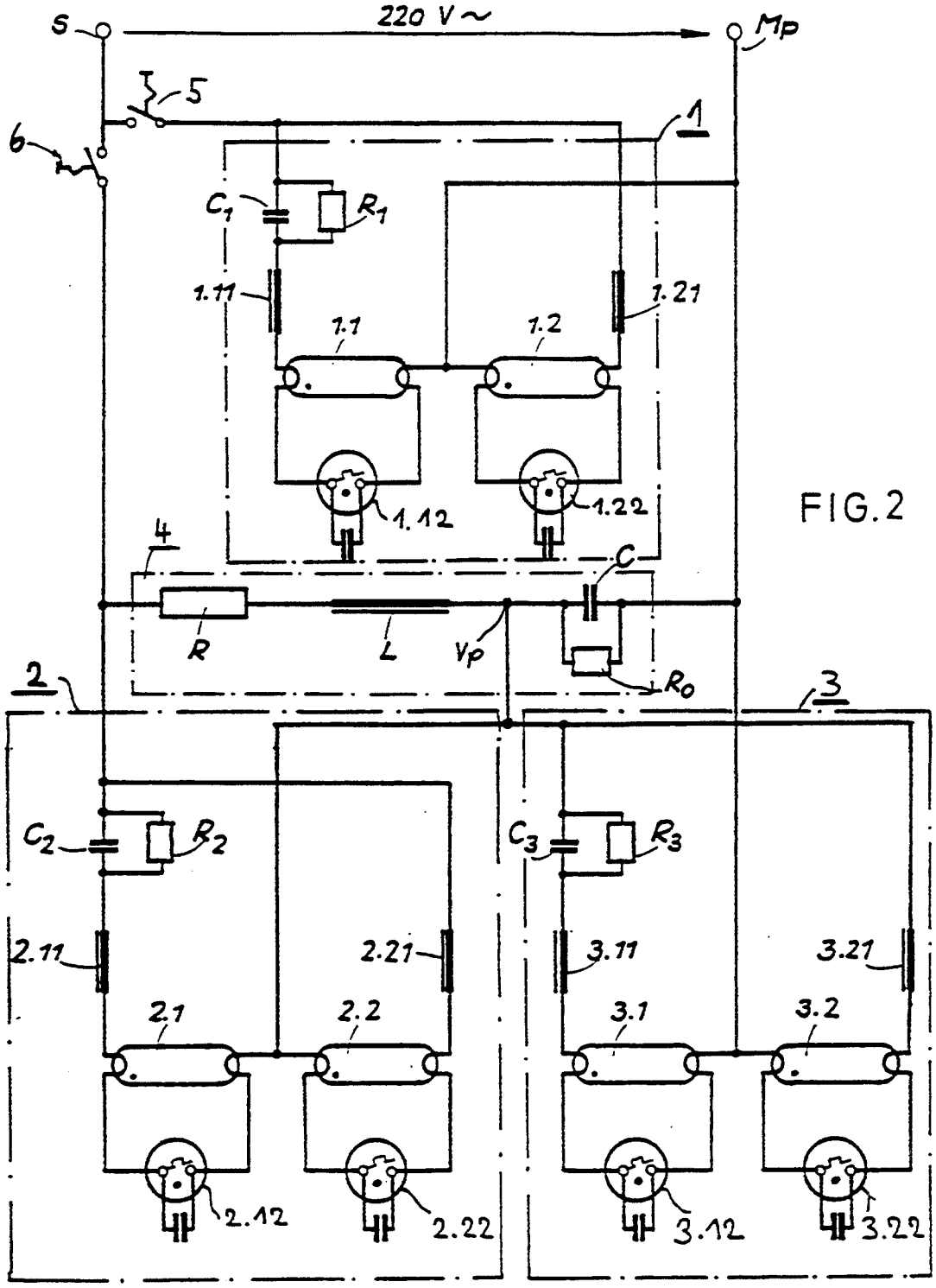

Two embodiments of the invention are explained in greater detail in the following by reference to the drawing, in which:

FIG. 1 schematically shows a wiring diagram of a circuit arrangement according to the invention for operating three fluorescent lamps; and FIG. 2 schematically shows a wiring diagram of a circuit arrangement according to the invention for operating six fluorescent lamps, whereby two fluorescent lamps are combined in each case in pairs to form one duo-circuit.

The circuit arrangement shown in FIG. 1 has the three lamp circuits 1, 2 and 3, which are arranged between the phase S and the center conductor Mp of a low-frequency alternating voltage source. In the present exemplified embodiment, the lamp circuits 1, 2 and 3 each contain in the known way a fluorescent lamp 1.1, 2.1 and 3.1; an inductivity resistor 1.11, 2.11 and 3.11, and a starter device 1.12, 2.12 and 3.13.

The first lamp circuit 1 is disposed directly between the phase S and the center conductor Mp of the single-phase alternating voltage source. A series oscillating circuit denoted in its totality by the reference symbol 4 is connected in parallel to the first lamp circuit 1, said series oscillating circuit consisting of an inductive resistor L and a capacitor C and, furthermore, having a tuning resistor R as well as a discharge resistor $R_o$ connected in parallel to the capacitor C. The point of connection between the inductive resistor L and the capacitor C within the series oscillating circuit 4 is denoted by Vp.

The second lamp circuit 2 is disposed between said point of connection Vp and the phase S of the single-phase alternating voltage source. The third lamp circuit 3 is disposed between said point of connection Vp and the center conductor Mp of the single-phase alternating voltage source. In this arrangement, the series oscillating circuit 4 and the lamp circuits 1, 2 and 3 are tuned to each other in such a way that a phase displacement of 60° is obtained between the individual fluorescent lamps 1.1, 2.1 and 3.1.

A switch 5 is associated with the first lamp circuit 1, with which switch said lamp circuit can be switched on and off separately. Provision is made for a further switch 6 between the phase S and the series oscillating circuit 4 or the lamp circuit 2. With the help of the switches 5 and 6 it is possible to selectively operate the lamp circuit 1 or the two lamp circuits 2 and 3 or the three lamp circuits 1, 2 and 3 jointly.

The exemplified embodiment of FIG. 2 largely conforms to the exemplified embodiment of FIG. 1, so that it was possible to use the same reference symbols for identical parts. With the exemplified embodiment of FIG. 2, each lamp circuit 1, 2 and 3 contains the two fluorescent lamps 1.1, 1.2; 2.1, 2.2; 3.1, 3.2, with the associated inductive resistors 1.11, 1.21; 2.11, 2.21; 2.12, 2.22; 3.12, 3.22. In addition, each lamp circuit 1, 2, 3 contains a capacitor C1, C2, C3, in each case arranged ahead of the inductive resistor 1.11, 2.11, 3.11 of the first fluorescent lamp 1.1, 2.1, 3.1 in each case, with a discharge resistor R1, R2, R3 being connected in parallel to each of said capacitors C1, C2, C3. Such duo-circuits, which are known per se, lead to a superpositioning of the luminous flux of the fluorescent tubes 1.1, 1.2; 2.1, 2.2; 3.1, 3.2 interconnected in each duo-circuit, and, in connection with the series oscillating circuit 4 proposed according to the invention, to an even substantially superior harmonization of the luminous flux.

In deviation from the two exemplified embodiments shown, it is possible to use in the individual lamp circuits instead of each individual fluorescent tube also two or more fluorescent tubes connected in series one after the other, which makes it possible according to the invention to connect a great number of fluorescent tubes with each other.

I claim:

1. Circuitry for operating at least three fluorescent lamps with no stroboscopic effects in a single-phase alternating voltage source, whereby each lamp circuit (1; 2; 3) has at least one inductive resistor (1.11; 2.11; 3.11) and one starter device (1.12, 2.12, 3.12), characterized in that a first lamp circuit (1) is connected in the usual way to the two conductors (S; Mp) of the single-phase alternating voltage source;

a series oscillating circuit (4) consisting of an inductive resistor (L) and a capacitor (C) is arranged in parallel with the first lamp circuit (1); and a second lamp circuit (2) is connected between a conductor (S) of the single-phase alternating voltage source and the point of connection (Vp) of the inductive resistor (L) and the capacitor (C) of the series oscillating circuit (4), and a third lamp circuit (3) is connected between said point of connection (Vp) and the other conductor (Mp) of the single-phase alternating voltage source.

2. Circuitry according to claim 1, characterized in that the phase displacement between the three lamp circuits (1; 2; 3) amounts to about 60°.

3. Circuitry according to claim 1, characterized in that each lamp circuit (1; 2; 3) has at least two fluorescent lamps (1.1. 1.2; 2.1. 2.2; 3.1, 3.2) connected by duo-circuit.

* * * * *